US009857101B2

(12) United States Patent
Radcliff et al.

(10) Patent No.: US 9,857,101 B2
(45) Date of Patent: Jan. 2, 2018

(54) REFRIGERATION EJECTOR CYCLE HAVING CONTROL FOR SUPERCRITICAL TO SUBCRITICAL TRANSITION PRIOR TO THE EJECTOR

(75) Inventors: Thomas D. Radcliff, Vernon, CT (US); Parmesh Verma, Manchester, CT (US); Jinliang Wang, Ellington, CT (US); Frederick J. Cogswell, Glastonbury, CT (US)

(73) Assignee: Carrier Corporation, Jupiter, FL (US)

( * ) Notice: Subject to any disclaimer, the term of this patent is extended or adjusted under 35 U.S.C. 154(b) by 720 days.

(21) Appl. No.: 13/811,313

(22) PCT Filed: Jul. 20, 2011

(86) PCT No.: PCT/US2011/044617
§ 371 (c)(1),
(2), (4) Date: Jan. 21, 2013

(87) PCT Pub. No.: WO2012/012490
PCT Pub. Date: Jan. 26, 2012

(65) Prior Publication Data

US 2013/0111930 A1 May 9, 2013

Related U.S. Application Data

(60) Provisional application No. 61/367,140, filed on Jul. 23, 2010.

(51) Int. Cl.
*F25B 1/06* (2006.01)
*F25B 9/00* (2006.01)
*F25B 41/00* (2006.01)

(52) U.S. Cl.
CPC ..... *F25B 1/06* (2013.01); *F25B 9/008* (2013.01); *F25B 41/00* (2013.01);
(Continued)

(58) Field of Classification Search
CPC ..... F25B 1/06; F25B 9/02; F25B 9/04; F25B 9/08; F25B 41/00; F25B 2309/02;
(Continued)

(56) References Cited

U.S. PATENT DOCUMENTS 1,836,318 A 12/1931 Gay
3,277,660 A 10/1966 Kemper et al.
(Continued)

FOREIGN PATENT DOCUMENTS

CN 1316636 A 10/2001
CN 101566407 A 10/2009
(Continued)

OTHER PUBLICATIONS

Chinese Office Action for Chinese Patent Application No. 201180036112.7, dated Sep. 1, 2014.
(Continued)

*Primary Examiner* — Davis Hwu
*Assistant Examiner* — Ana Vazquez
(74) *Attorney, Agent, or Firm* — Bachman & LaPointe, P.C.

(57) ABSTRACT

A system (170) has a compressor (22). A heat rejection heat exchanger (30) is coupled to the compressor to receive refrigerant compressed by the compressor. A non-controlled ejector (38) has a primary inlet coupled to the heat rejection exchanger to receive refrigerant, a secondary inlet, and an outlet. The system includes means (172, e.g., a nozzle) for causing a supercritical-to-subcritical transition upstream of the ejector.

18 Claims, 5 Drawing Sheets

(52) U.S. Cl.
CPC . *F25B 2309/061* (2013.01); *F25B 2341/0011* (2013.01); *F25B 2341/0013* (2013.01); *F25B 2600/21* (2013.01); *F25B 2700/197* (2013.01); *F25B 2700/21175* (2013.01)

(58) Field of Classification Search
CPC ..... F25B 2341/001; F25B 2341/0011; F25B 2700/197; F25B 2700/21175; F25B 2309/061; F25B 2341/0013; F25B 9/008
USPC ..... 62/500
See application file for complete search history.

(56) References Cited

U.S. PATENT DOCUMENTS

| | | | | |
|---|---|---|---|---|
| 3,680,327 | A | 8/1972 | Stein | |
| 3,742,726 | A | 7/1973 | English | |
| 4,240,263 | A | 12/1980 | Brendel | |
| 4,548,053 | A | 10/1985 | Brown | |
| 5,343,711 | A | 9/1994 | Kornhauser et al. | |
| 6,622,495 | B2 | 9/2003 | Nishii | |
| 6,837,069 | B2 * | 1/2005 | Takeuchi et al. | 62/500 |
| 6,904,769 | B2 * | 6/2005 | Ogata et al. | 62/500 |
| 6,966,199 | B2 | 11/2005 | Takeuchi | |
| 7,024,883 | B2 | 4/2006 | Sienel et al. | |
| 7,207,186 | B2 | 4/2007 | Hirota | |
| 7,559,212 | B2 | 7/2009 | Bergander | |
| 2004/0007014 | A1 * | 1/2004 | Takeuchi et al. | 62/500 |
| 2004/0079102 | A1 * | 4/2004 | Umebayashi et al. | 62/324.1 |
| 2004/0123624 | A1 | 7/2004 | Ohta et al. | |
| 2004/0255610 | A1 * | 12/2004 | Nishijima et al. | 62/500 |
| 2005/0028552 | A1 * | 2/2005 | Nishijima et al. | 62/500 |
| 2005/0044881 | A1 * | 3/2005 | Ogata et al. | 62/500 |
| 2005/0155374 | A1 * | 7/2005 | Oshitani et al. | 62/500 |
| 2005/0188719 | A1 * | 9/2005 | Sugiura | B41J 2/17596 62/500 |
| 2006/0254308 | A1 * | 11/2006 | Yokoyama et al. | 62/500 |
| 2007/0000262 | A1 | 1/2007 | Ikegami et al. | |
| 2007/0028630 | A1 | 2/2007 | Yamada et al. | |
| 2007/0163293 | A1 * | 7/2007 | Ikegami et al. | 62/500 |
| 2008/0196446 | A1 | 8/2008 | Nakamura et al. | |
| 2009/0013704 | A1 | 1/2009 | Oshitani et al. | |
| 2009/0095013 | A1 | 4/2009 | Ikegami et al. | |
| 2009/0229304 | A1 | 9/2009 | Ogata et al. | |
| 2009/0229305 | A1 | 9/2009 | Yamada et al. | |
| 2010/0095700 | A1 * | 4/2010 | Bush | F25B 41/00 62/323.3 |
| 2010/0247405 | A1 * | 9/2010 | Nagamori et al. | 422/187 |
| 2011/0100038 | A1 | 5/2011 | Haussmann | |

FOREIGN PATENT DOCUMENTS

| | | | |
|---|---|---|---|
| DE | 102005021396 | A1 | 11/2006 |
| DE | 102008005076 | A1 | 7/2009 |
| EP | 1134517 | A2 | 9/2001 |
| JP | 2006038400 | A | 2/2006 |
| WO | 2008/130412 | A1 | 10/2008 |

OTHER PUBLICATIONS

International Search Report and Written Opinion for PCT/US2011/044617, dated Jan. 11, 2012.
Chinese Office Action for Chinese Patent Application No. 201180036112.7, dated Apr. 23, 2015.
Chinese Office Action for Chinese Patent Application No. 201180036112.7, dated Oct. 16, 2015.

* cited by examiner

REFRIGERATION EJECTOR CYCLE HAVING CONTROL FOR SUPERCRITICAL TO SUBCRITICAL TRANSITION PRIOR TO THE EJECTOR

CROSS-REFERENCE TO RELATED APPLICATION

Benefit is claimed of U.S. Patent Application Ser. No. 61/367,140, filed Jul. 23, 2010, and entitled "Ejector Cycle", the disclosure of which is incorporated by reference herein in its entirety as if set forth at length.

BACKGROUND

The present disclosure relates to refrigeration. More particularly, it relates to ejector refrigeration systems.

Earlier proposals for ejector refrigeration systems are found in U.S. Pat. No. 1,836,318 and U.S. Pat. No. 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector (FIG. 3) or may be a controllable ejector (FIG. 2). FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Various modifications of such ejector systems have been proposed. One example in US20070028630 involves placing a second evaporator along the line 46. US20040123624 discloses a system having two ejector/evaporator pairs. Another two-evaporator, single-ejector system is shown in US20080196446. Another method proposed for controlling the ejector is by using hot-gas bypass. In this method a small amount of vapor is bypassed around the gas cooler and injected just upstream of the motive nozzle, or inside the convergent part of the motive nozzle. The bubbles thus introduced into the motive flow decrease the effective throat area and reduce the primary flow. To reduce the flow further more bypass flow is introduced.

SUMMARY

One aspect of the disclosure involves a system having a compressor. A heat rejection heat exchanger is coupled to the compressor to receive refrigerant compressed by the compressor. A non-controlled ejector has a primary inlet coupled to the heat rejection exchanger to receive refrigerant, a secondary inlet, and an outlet. The system includes means (e.g., a nozzle) for causing a supercritical-to-subcritical transition upstream of the ejector.

In various implementations, the means may consist essentially of a nozzle and a control valve. The nozzle may be a convergent nozzle or a convergent/divergent (convergent-divergent) nozzle. The means may be non-branching and inline between the heat rejection heat exchanger and the ejector. The system may further include a separator having an inlet coupled to the outlet of the ejector to receive refrigerant from the ejector. The separator has a gas outlet coupled to the compressor to return refrigerant to the compressor. The separator has a liquid outlet coupled to the secondary inlet of the ejector to deliver refrigerant to the ejector. A heat absorption heat exchanger may be coupled to the liquid outlet of the separator to receive refrigerant.

An expansion device may be immediately upstream of the heat absorption heat exchanger. The refrigerant may comprise at least 50% carbon dioxide, by weight.

Other aspects of the disclosure involve methods for operating the system.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
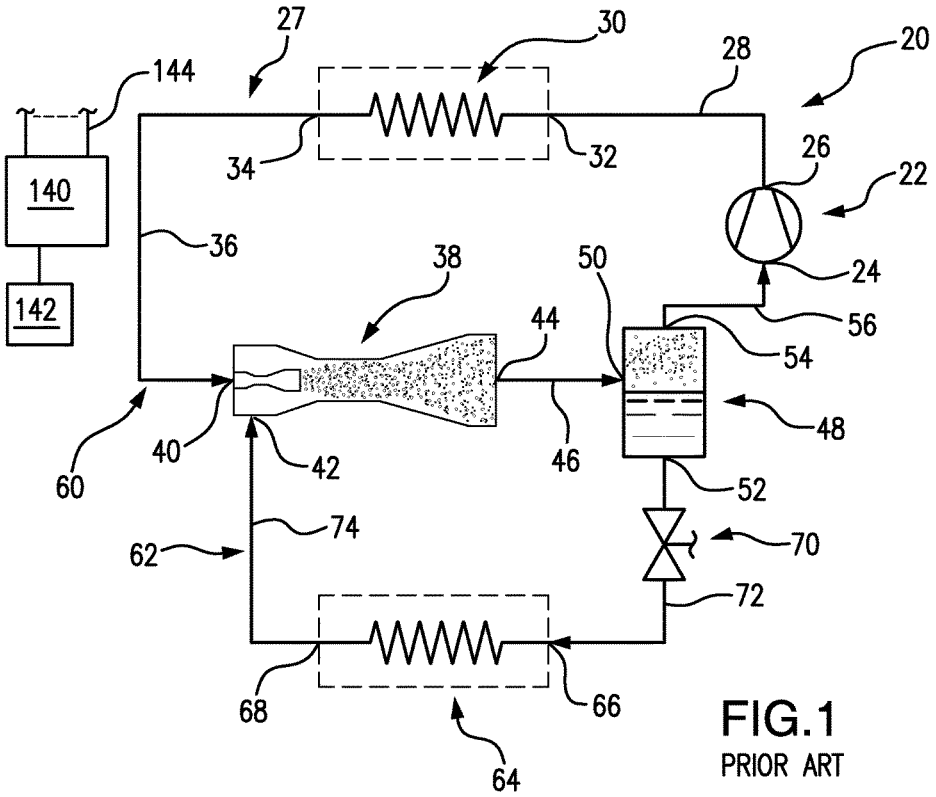
FIG.1 PRIOR ART
FIG. 1 is a schematic view of a prior art ejector refrigeration system.
Figure 2:
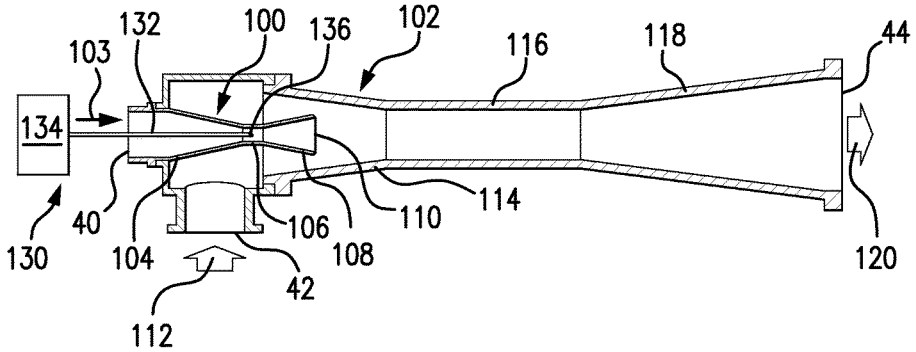
FIG. 2 PRIOR ART
FIG. 2 is an axial sectional view of an ejector.
Figure 3:
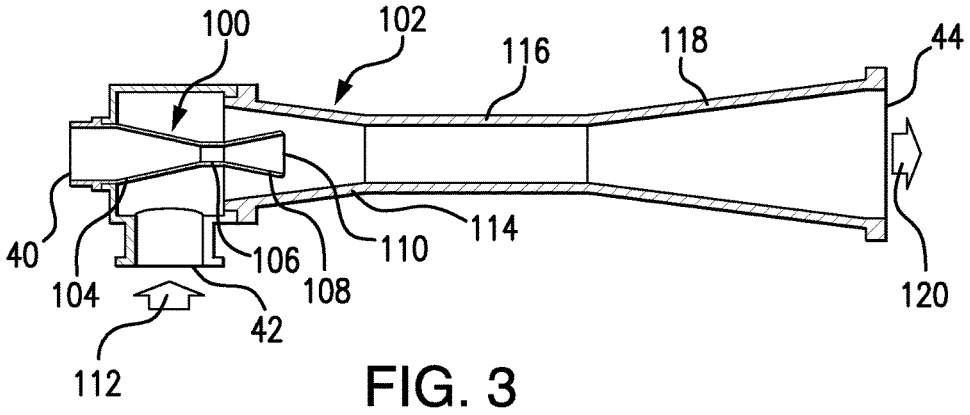
FIG. 3 is an axial sectional view of a second ejector.
Figure 4:
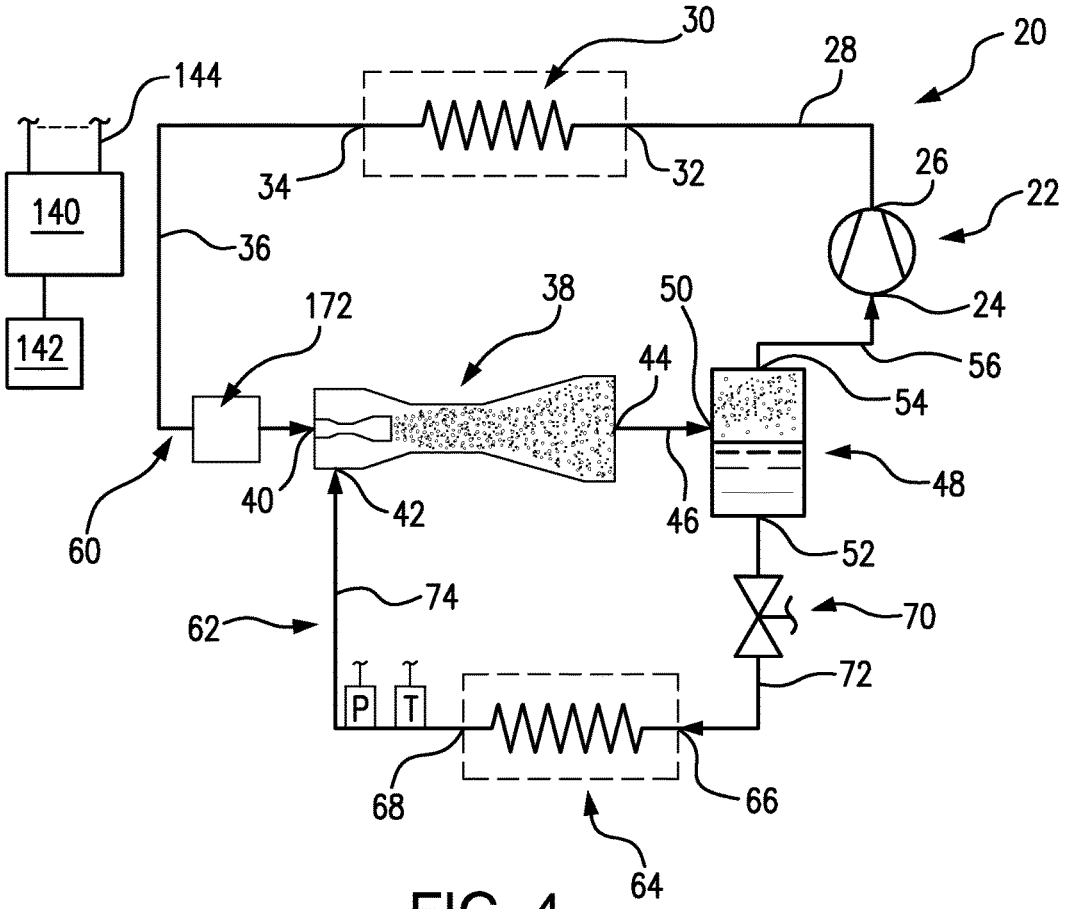
FIG. 4 is a schematic view of a first refrigeration system.
Figure 7:
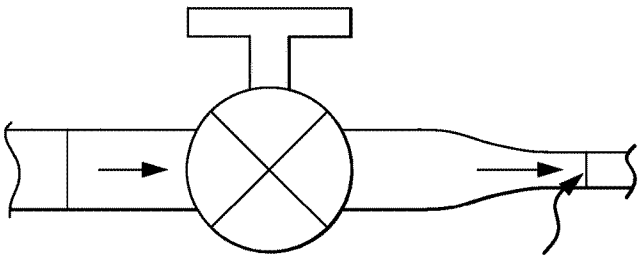
FIG. 7 is a view of a second transitioning means.

FIG. 4 shows an ejector cycle vapor compression (refrigeration) system 170. The system 170 may be made as a modification of the system 20 or of another system or as an original manufacture/configuration. In the exemplary embodiment, like components which may be preserved from the system 20 are shown with like reference numerals. Operation may be similar to that of the system 20 except as discussed below with the controller controlling operation responsive to inputs from various temperature sensors and pressure sensors The ejector is a non-controllable ejector. Directly upstream of the ejector primary inlet is a means 172 for providing a supercritical-to-subcritical transition of refrigerant before entering the primary inlet. A first exemplary means comprises a convergent nozzle 180 (FIG. 5) and a control valve 182 in series therewith. The convergent nozzle 180 has an inlet 184 and an outlet 186 A flow cross-sectional (interior surface) area of the outlet is less than that of the inlet (e.g., 10-95%, more narrowly, 20-80% or 40-60%). The outlet cross-sectional area may be nominally the same as that of the ejector primary inlet and any intervening conduit/line. The inlet cross-sectional area may be the same as the conduit/line from the heat rejection heat exchanger. The exemplary valve (e.g., a needle valve or ball valve) may be directly upstream of the inlet 184 or downstream of the outlet (FIG. 7).

Figure 5:
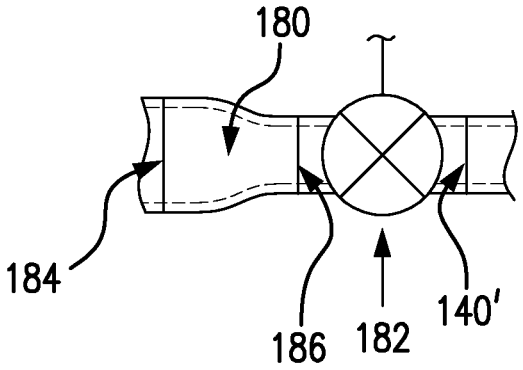
FIG. 5 is a view of a first refrigerant transitioning means.
Figure 6:
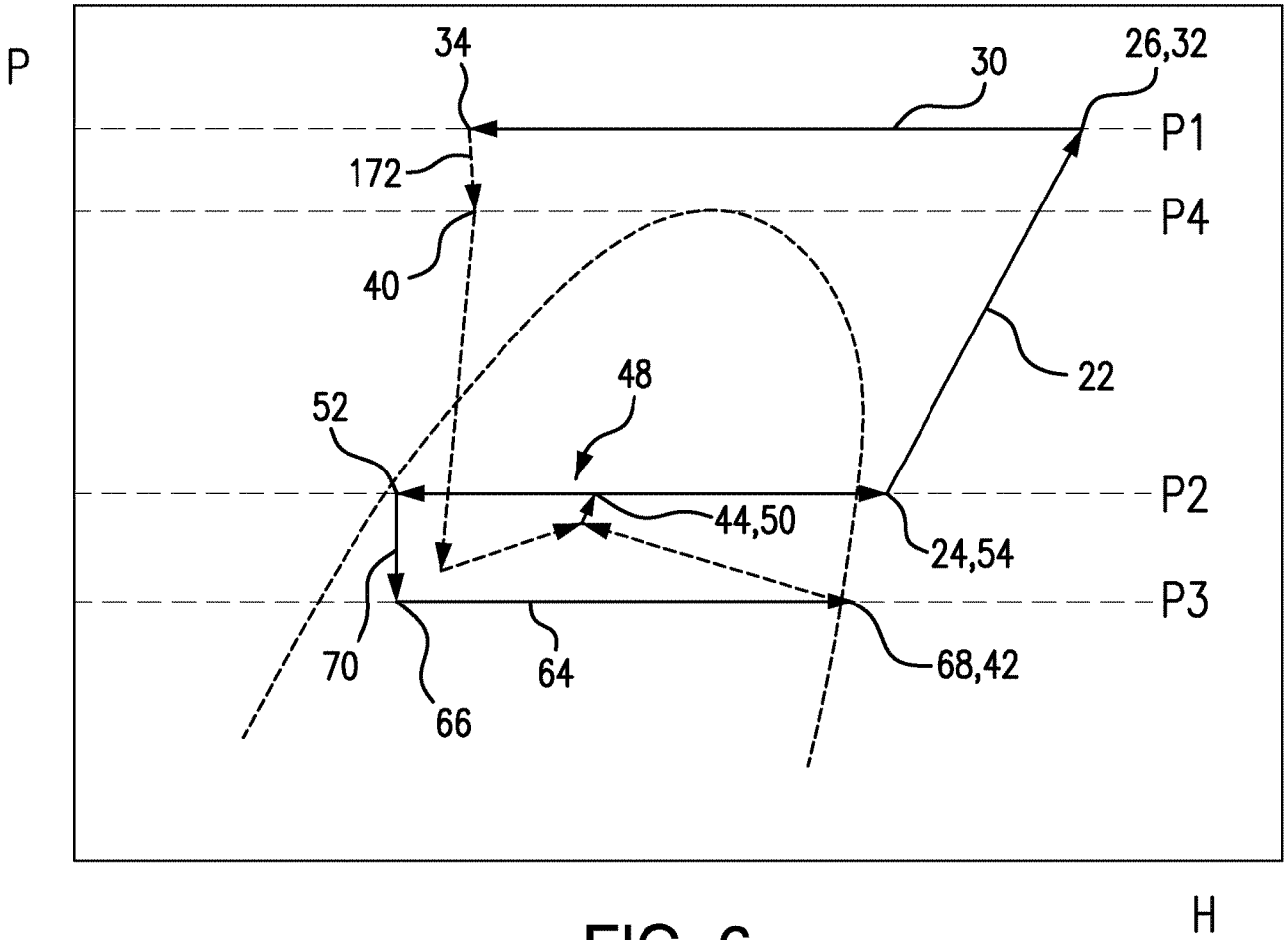
FIG. 6 is a pressure-enthalpy (Mollier) diagram of the system of FIG. 4.

FIG. 6 is a Mollier diagram of the system of FIG. 4 with the means of FIG. 5. The exemplary evaporator pressure is P3 and the discharge or high side gas cooler pressure is P1. The means 172 lowers the ejector inlet pressure to P4. The flow rate and inlet condition of the motive nozzle can be controlled by the means 172 to keep the ejector motive nozzle inlet pressure below critical.

In operation, the expansion device 70 is controlled to maintain a desired superheat of refrigerant exiting the evaporator. A target superheat exiting the evaporator may be maintained. The superheat may be determined by input from a pressure transducer P and temperature sensor T downstream of the evaporator. Alternatively, the pressure can be estimated from a temperature sensor along the saturated region of the evaporator. To increase superheat, the expansion device is closed, to increase opened.

Figure 8:
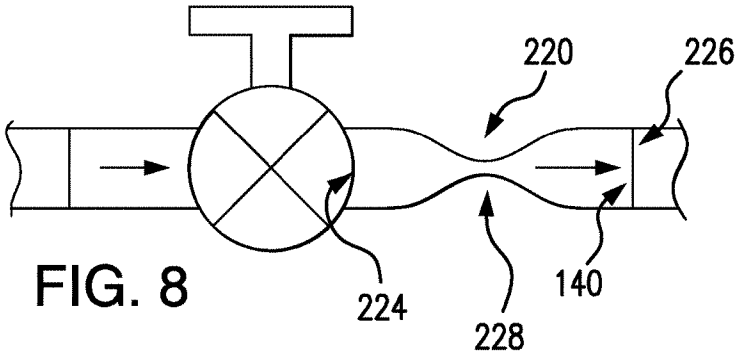
FIG. 8 is a view of a third transitioning means.

A third exemplary means comprises a convergent-divergent nozzle 220 (FIG. 8) in place of the convergent nozzle 180. The convergent-divergent nozzle 220 has an inlet 224 and an outlet 226, and a throat 228, between the inlet and the outlet. A flow cross-sectional (interior surface) area of the throat is less than that of the smaller of the inlet and outlet (e.g., 10-95%, more narrowly, 20-80% or 40-60%). An exemplary flow cross-sectional (interior surface) area of the outlet is greater or less (depending on the outlet refrigerant velocity requirement; higher velocity demands the outlet area be greater, less for lower velocity) than that of the inlet (e.g., 20-175%, more narrowly, 50-150%). The outlet cross-sectional area may be nominally the same as that of the ejector primary inlet and any intervening conduit/line. The inlet cross-sectional area may be the same as the conduit/line from the heat rejection heat exchanger.

Figure 9:
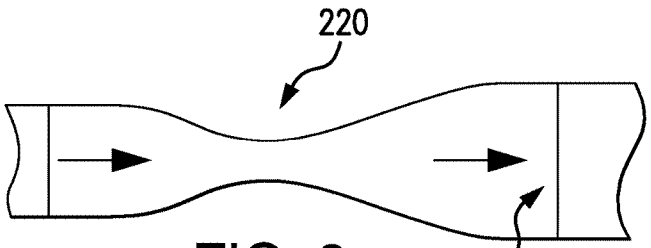
FIG. 9 is a view of a fourth transitioning means.

Further variations on the means involve omitting the control valve 182 (FIG. 9 for the nozzle 220). In such situations, the dimensions of the nozzle 180 or 220 are pre-selected to maintain the ejector inlet pressure below the critical pressure over the anticipated range of operating conditions.

Figure 10:
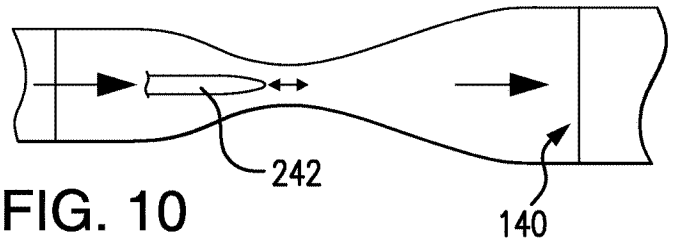
FIG. 10 is a view of a fifth transitioning means.

Yet further variations of the means modify the nozzle 220 to have a controllable flow cross-section. For a convergent-divergent nozzle 240 (FIG. 10), this may involve a controllable throat cross-section (e.g., via a needle valve having a needle 242 and an actuator (not shown). The needle may be controlled to control the nozzle outlet pressure or system parameters such as flow rates and temperatures, etc.

Figure 11:
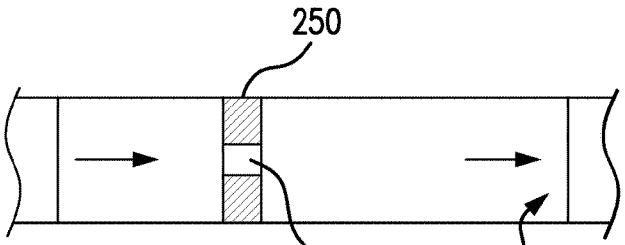
FIG. 11 is a view of a sixth transitioning means.

FIG. 11 shows yet a further variation on the means involving an orifice plate 250 having an orifice 252. An exemplary orifice 252 is an orifice plate or Venturi tube. Yet further variations of the means involve a series of convergent and/or convergent-divergent nozzles with or without control valves. For example, there may be just a convergent nozzle before the ejector.

The system may be fabricated from conventional components using conventional techniques appropriate for the particular intended uses.

Although an embodiment is described above in detail, such description is not intended for limiting the scope of the present disclosure. It will be understood that various modifications may be made without departing from the spirit and scope or the disclosure. For example, when implemented in the remanufacturing of an existing system of the reengineering of an existing system configuration, details of the existing configuration may influence or dictate details of any particular implementation. Accordingly, other embodiments are within the scope of the following claims.

What is claimed is:

1. A method for operating a system, the system comprising:

a compressor;

a heat rejection heat exchanger coupled to the compressor to receive refrigerant compressed by the compressor;

an ejector having:

a primary inlet coupled to the heat rejection heat exchanger to receive refrigerant;

a secondary inlet;

an outlet; and a motive nozzle between the primary inlet and the outlet;

a heat absorption heat exchanger coupled to the outlet of the ejector to receive refrigerant; and at least one nozzle inline between the heat rejection heat exchanger and the primary inlet, the method comprising running the compressor in a first mode wherein:

the refrigerant is compressed in the compressor;

refrigerant received from the compressor by the heat rejection heat exchanger rejects heat in the heat rejection heat exchanger to produce initially cooled refrigerant; and the initially cooled refrigerant passes through the at least one nozzle and transitions in the at least one nozzle from supercritical to subcritical and enters the primary inlet subcritical.

2. The method of claim 1 wherein:

a control system controls flow through the at least one nozzle by receiving input from one or more sensors; and responsive to the input, controlling the at least one nozzle so as to maintain motive nozzle inlet pressure below supercritical.

3. A system (170) comprising:

a compressor (22);

a heat rejection heat exchanger (30) coupled to the compressor to receive refrigerant compressed by the compressor;

an ejector (38) having:

a primary inlet (40) coupled to the heat rejection heat exchanger to receive refrigerant;

a secondary inlet (42);

an outlet (44); and a motive nozzle (100) between the primary inlet and the outlet;

a heat absorption heat exchanger (64) coupled to the outlet of the ejector to receive refrigerant; and at least one nozzle inline between the heat rejection heat exchanger and the primary inlet, so that a flowpath passes sequentially through the at least one nozzle and then to the motive nozzle primary inlet.

4. The system of claim 3 wherein:

the at least one nozzle comprises a convergent nozzle or convergent-divergent nozzle.

5. The system of claim 3 wherein:

the at least one nozzle consists of a single nozzle being a convergent nozzle or convergent-divergent nozzle.

6. The system of claim 5 further comprising:

a control valve either upstream of an inlet of the single nozzle or downstream of an outlet of the single nozzle.

7. The system of claim 6 wherein:

the refrigerant comprises at least 50% carbon dioxide, by weight.

8. The system of claim 3 wherein:

the refrigerant comprises at least 50% carbon dioxide, by weight.

9. The system of claim 3 further comprising:

a separator (48) having:

an inlet (50) coupled to the outlet of the ejector to receive refrigerant from the ejector;

a gas outlet (54) coupled to the compressor to return refrigerant to the compressor; and a liquid outlet (52) coupled to the secondary inlet of the ejector to deliver refrigerant to the ejector, wherein:

the heat absorption heat exchanger (64) is between the separator and the secondary inlet.

10. The system of claim 9 wherein:

the system has no other separator.

11. The system of claim 9 wherein:

the refrigerant comprises at least 50% carbon dioxide, by weight.

12. The system of claim 3 further comprising:

an expansion device (70) immediately upstream of an inlet (66) of the heat absorption heat exchanger (64).

13. The system (170) of claim 3 wherein:

the ejector is a non-controlled ejector.

14. The system of claim 13 wherein:

the at least one nozzle comprises a convergent-divergent nozzle.

15. The system of claim 13 wherein:

a control valve is in series with the at least one nozzle.

16. The system of claim 15 wherein:

the at least one nozzle comprises a convergent nozzle.

17. The system of claim 15 wherein:

the at least one nozzle comprises a convergent-divergent nozzle.

18. The system of claim 3 wherein:

a flowpath is non-branching between the heat rejection heat exchanger and the ejector.

* * * * *